US011104027B2

(12) United States Patent
Fife

(10) Patent No.: US 11,104,027 B2
(45) Date of Patent: Aug. 31, 2021

(54) PUSH BLOCK FOR ADVANCING WORK PIECE OVER TABLE SAW

(71) Applicant: ETN CAPITAL LLC, Sanford, NC (US)

(72) Inventor: Taylor Fife, Sanford, NC (US)

(73) Assignee: ETN Capital LLC, Sanford, NC (US)

( * ) Notice: Subject to any disclaimer, the term of this patent is extended or adjusted under 35 U.S.C. 154(b) by 65 days.

(21) Appl. No.: 16/680,505

(22) Filed: Nov. 12, 2019

(65) Prior Publication Data

US 2021/0138682 A1 May 13, 2021

(51) Int. Cl.
*B27B 25/10* (2006.01)
*B27B 27/02* (2006.01)
*B26D 7/22* (2006.01)

(52) U.S. Cl.
CPC ..... *B27B 25/10* (2013.01); *B26D 7/22* (2013.01); *B27B 27/02* (2013.01)

(58) Field of Classification Search
CPC ..... B27B 25/10; B27B 27/02; B26D 7/22
USPC ..... 83/436.2
See application file for complete search history.

(56) References Cited

U.S. PATENT DOCUMENTS 3,994,484 A * 11/1976 Schorr ..... B27B 27/04 269/315
4,448,406 A * 5/1984 Hallberg ..... B25B 1/103 269/224
4,516,612 A 5/1985 Wiley
5,381,595 A * 1/1995 Keith, Jr. ..... B23Q 5/54 144/136.95
5,913,382 A * 6/1999 Martin ..... E06C 7/44 182/204
6,131,719 A * 10/2000 Gore ..... B66B 29/02 198/323
6,557,601 B1 * 5/2003 Taylor ..... B27B 27/02 144/253.1
6,702,066 B1 * 3/2004 Eaton ..... E06C 7/44 182/201
6,736,042 B2 5/2004 Behne et al.
7,886,641 B2 2/2011 Wirth, Jr. et al.
D665,638 S 8/2012 Krohmer et al.
8,826,788 B2 9/2014 Rybka
9,227,337 B2 1/2016 Wang
9,440,371 B2 * 9/2016 van Valkenburg ..... B27C 5/06
2006/0185485 A1 * 8/2006 Wang ..... B27C 5/06 83/436.2
2012/0118120 A1 5/2012 Niichel

* cited by examiner

*Primary Examiner* — Kenneth E Peterson
*Assistant Examiner* — Liang Dong
(74) *Attorney, Agent, or Firm* — Kanika Radhakrishnan; Evergreen Valley Law Group

(57) ABSTRACT

A push block for advancing a work piece over a table saw is disclosed. The push block includes a table-top; a handle mounted on the table-top; a first leg having a proximal end mounted on a first side of the table-top, where the first leg includes a first grip member arranged on distal end of the first leg; a second leg having a proximal end movably mounted underneath the table-top, the second leg is spaced apart from the first leg to form a cut tunnel therebetween, where the second leg includes a second grip member arranged on a distal end of the second leg; a maneuvering mechanism, arranged on the table-top, for moving the second leg to adjust a width of the cut tunnel; and a balancing wheel slidably mounted on a second side, opposite to the first side, of the table-top.

19 Claims, 3 Drawing Sheets

PUSH BLOCK FOR ADVANCING WORK PIECE OVER TABLE SAW

TECHNICAL FIELD

The present disclosure relates generally to handling work piece on a machine and, more particularly to, a push block for advancing a work piece over a table saw.

BACKGROUND

Push block is a device or an apparatus that is used in conjunction with a table saw for advancing a work piece towards a saw blade of the table saw. Such push block typically includes a body having a flat surface configured to engage with a surface of the work piece. Further, the push block is provided with a handle for an operator to grasp and advance the work piece with a forward pushing force to be applied with the handle on the work piece. The use of the push block allows easy and safe handling of the work piece over the table saw.

However, the conventional push blocks are still subjected to various operational challenges. For example, the conventional push blocks are not suitable for making narrow and precise rip cuts (of about 0.25 inches) on a work piece. For cutting such narrow and precise rip cuts, a work piece needs to be firmly held over at minimum two sides (or portions) maintaining a narrow gap therebetween, which allows the saw blade to pass therethrough. The conventional push blocks fail to firmly hold the work piece from two sides maintaining a narrow gap between the two sides. Further, making the narrow rip cuts becomes more challenging when a work piece itself is narrow, i.e. when a width of the work piece (or stoke) is small, for example, of about 1 inch, and the work piece still needs to be subjected to a narrow rip cut (of about 0.25 inches). Typically, in such situations, the conventional push block fails to make balance and firm grip over the narrow work piece, which may, in turn, causes the push block to be unstable. An unstable push block may damage the work piece when subject to rip cut or may give rise to safety issues for the operator handling the work piece on the table saw.

In light of the foregoing discussion, there exists a need to overcome the aforementioned drawbacks associated with conventional push block for handing a work piece.

SUMMARY

Various embodiments of the present disclosure provide a push block for advancing a work piece over a table saw.

In an embodiment, a push block for advancing a work piece over a table saw is disclosed. The push block includes a table-top; a handle mounted on the table-top; a first leg having a proximal end mounted on a first side of the table-top, wherein the first leg includes a first grip member arranged on distal end of the first leg; a second leg having a proximal end movably mounted underneath the table-top, the second leg is spaced apart from the first leg to form a cut tunnel therebetween, wherein the second leg includes a second grip member arranged on a distal end of the second leg; and a maneuvering mechanism, arranged on the table-top, for moving the second leg to adjust a width of the cut tunnel.

In another embodiment, a push block for advancing a work piece over a table saw is disclosed. The push block includes s a table-top; a handle mounted on the table-top; a first leg having a proximal end mounted on a first side of the table-top, wherein the first leg includes a first grip member arranged on a distal end of the first leg; and a second leg having a proximal end movably mounted underneath the table-top, the second leg is spaced apart from the first leg to form a cut tunnel therebetween, wherein the second leg includes a second grip member arranged on a distal end of the second leg. The push block also includes a maneuvering mechanism, arranged on the table-top, for moving the second leg to adjust a width of the cut tunnel. The maneuvering mechanism includes an elongate threaded rod having a first end coupled to the first leg, the elongate threaded rod passing through and threadably engaged with a support member arranged on an intermediate member of the second leg, and a rotating wheel threadably engaged with a second end of the elongate threaded rod. The table-top includes a cut-out section configured to receive the rotating wheel therein. The push block further includes a balancing disk slidably mounted on a second side, opposite to the first side, of the table-top.

In yet another embodiment, a push block for advancing a work piece over a table saw is disclosed. The push block includes a table-top; a handle mounted on the table-top; a first leg having a proximal end mounted on a first side of the table-top, wherein the first leg includes a first grip member arranged on a distal end of the first leg; and a second leg having a proximal end movably mounted underneath the table-top, the second leg is spaced apart from the first leg to form a cut tunnel therebetween, wherein the second leg includes a second grip member arranged on a distal end of the second leg. The push block also includes a maneuvering mechanism, arranged on the table-top, for moving the second leg to adjust a width of the cut tunnel. The maneuvering mechanism includes an elongate threaded rod having a first end coupled to the first leg, the elongate threaded rod passing through and threadably engaged with a support member arranged on an intermediate member of the second leg, and a rotating wheel threadably engaged with a second end of the elongate threaded rod, wherein the table-top includes a cut-out section configured to receive the rotating wheel therein. The push block further includes a balancing disk slidably mounted on a second side, opposite to the first side, of the table-top. The balancing disk includes a pair of spaced apart T-shaped tabs arranged along a face of the balancing disk, wherein the second side of the table-top includes a pair of spaced apart recesses configured to receive the pair of T-shaped tabs therein to allow the pair of T-shaped tabs to slidably move along the pair of recesses.

Other aspects and example embodiments are provided in the drawings and the detailed description that follows.

BRIEF DESCRIPTION OF THE FIGURES

For a more complete understanding of example embodiments of the present technology, reference is now made to the following descriptions taken in connection with the accompanying drawings in which.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification is not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Figure 1:
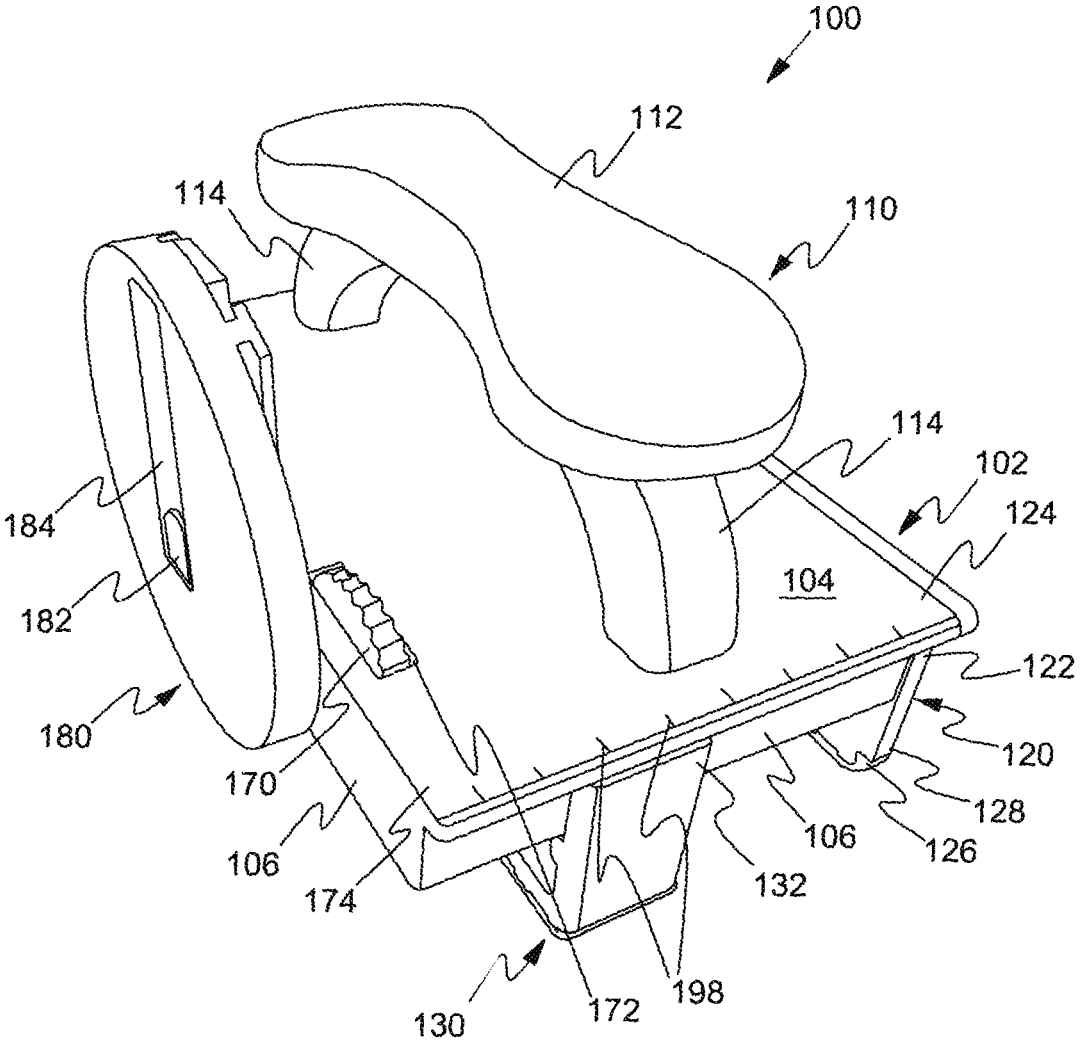
FIGS. 1-2 are perspective views of a push block, in accordance with example embodiments of the present disclosure.
Figure 2:
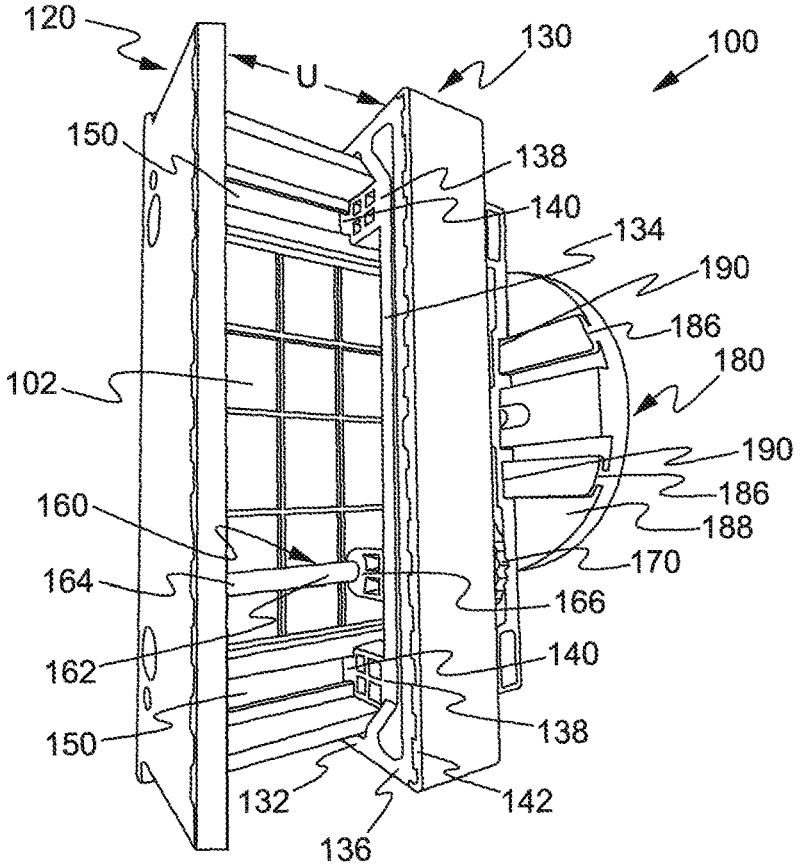

Referring now to the drawings, FIGS. 1-2 are perspective views of a push block 100, in accordance with various example embodiments. Specifically, FIG. 1 illustrates a front perspective view of the push block 100. The push block 100 includes a table-top 102, which is a rectangular structure. As shown, the table-top 102 includes a planer top 104 and side walls, such as side walls 106, extending from the planer top 104.

The push block 100 also includes a handle 110 mounted on the table-top 102. As shown, the handle 110 includes a central grasping portion 112, and curved connecting members 114 extending from the central grasping portion 112 and coupled to the table-top 102. The handle 110 is an arcuate structure, with the central grasping portion 112 spaced apart from the table-top 102, forming an ergonomic handle 110.

The push block 100 further includes a first leg 120 having a proximal end 122 mounted on a first side 124 of the table-top 102. As shown, the first leg 120 is a planer structure with the proximal end 122 thereof rigidly mounted on the first side 124 of the table-top 102. Although the first leg 120 is rigidly mounted on the table-top 102, the first leg 120 is detachable from the table-top 102, i.e. the first leg 120 is detachably coupled to the table-top 102. Further, the first leg 120 is configured to have a small thickness, for example, the first leg 120 includes a thickness of 0.25 inches. However, it may be evident that the first leg 120 may include any other thickness, i.e. smaller than 0.25 inches, for example 0.20 or 0.15 or 0.10 inches, or larger than 0.25 inches, for example 0.30 or 0.35 or 0.40 inches.

The first leg 120 includes a first grip member 126 arranged on a distal end 128 of the first leg 120. The first grip member 126 is made of a material that allows the first leg 120 to attain firm grip over a work piece (for example, a wooden work piece) when the first leg 120 is pressed against the work piece, i.e. while advancing the work piece using the push block 100. In an embodiment, the first grip member 126 may be made of rubber, or any other material that enables in proving firm grip for the first leg 120 over the work piece.

The push block 100 also includes a second leg 130 having a proximal end 132 (shown in FIG. 2) movably mounted underneath the table-top 102. The second leg 130 is spaced apart from the first leg 120 to form a cut tunnel 'U' therebetween. Referring now to the FIG. 2, illustrated is a bottom perspective view of the push block 100. As shown in FIG. 2, the second leg 130 is an elongate U-shaped structure having an intermediate member 134 arranged between the proximal end 132 and a distal end 136 of the second leg 130 in a spaced apart manner. The intermediate member 134 includes a pair of spaced apart protruding members 138, each having a T-shaped portion 140 arranged thereon. It will be appreciated that the pair of protruding members 138 along with the T-shaped portion 140, constitutes the proximal end 132 of the second leg 130 that is movably mounted underneath the table-top 102. Specifically, the table-top 102 includes a pair of spaced apart channels 150 arranged underneath the table-top 102. The pair of channels 150 is configured to receive the T-shaped portion 140 of the pair of protruding members 138 to allow the T-shaped portion 140 to slidably move along the pair of channels 150.

According to an embodiment, the second leg 130 includes a thickness of 1 inch. However, it may be evident that the second leg 130 may include other thickness, i.e. smaller than 1 inch, for example 0.90 or 0.80 inches, or larger than 1 inch, for example 1.10 or 1.20 inches. The second leg 130 also includes a second grip member 142 arranged on the distal end 136 of the second leg 130. The second grip member 142 is also made of a material that allows the second leg 130 to attain firm grip over the work piece when the second leg 130 is pressed against the work piece, i.e. while advancing the work piece using the push block 100. In an embodiment, the second grip member 142 may be made of rubber or any other material that enables in providing firm grip for the second leg 130.

The push block 100 further includes a maneuvering mechanism 160, arranged on the table-top 102, for moving the second leg 130 to adjust a width of the cut tunnel 'U'. As shown, the maneuvering mechanism 160 includes an elongate threaded rod 162 having a first end 164 coupled to the first leg 120. The elongate threaded rod 162 passes through and threadably engages with a support member 166 arranged on the intermediate member 134. The maneuvering mechanism 160 also includes a rotating wheel 170 threadably engaged with a second end (not shown) of the elongate threaded rod 162. The table-top 102 includes a cut-out section 172 (shown in FIG. 1) configured to receive the rotating wheel 170 therein. As shown in FIGS. 1 and 2, the rotating wheel 170 therein partially protrudes above and below the table-top 102. The first end 164 and the second end of the elongate threaded rod 162 rotate freely when the rotating wheel 170 is rotated, and as mentioned herein the elongate threaded rod 162 is threadably engaged with the support member 166 (shown in FIG. 2), therefore the support member 166 moves (i.e. moves either left-right or back-forth) thereby slidably moving the second leg 130. The movement of the second leg 130 with respect to the first leg 120 enables in adjusting the width of the cut tunnel 'U'.

The push block 100 also includes a balancing disk 180 (shown in FIGS. 1 and 2) slidably mounted on a second side 174, opposite to the first side 124, of the table-top 102. Specifically, as shown in FIG. 1, the balancing disk 180 is slidably mounted on the side wall 106 arranged at the second side 174 of the table-top 102. According to an embodiment, the balancing disk 180 is slidably mounted on the second side 174 of the table-top 102 using a spring-loaded button 182. The balancing disk 180 includes a through channel 184 to operably receive the spring-loaded button 182 therethrough. The balancing disk 180 includes a pair of spaced apart T-shaped tabs 186 arranged along a face 188 of the balancing disk 180 (as shown in FIG. 2). The second side 174 of the table-top 102 includes a pair of spaced apart recesses 190 configured to receive the pair of T-shaped tabs 186 therein to allow the pair of T-shaped tabs 186 to slidably move along the pair of recesses 190. Specifically, when the spring-loaded button 182 is pushed, the balancing disk 180 becomes free from the second side 174 (or particularly from the side wall 106) of the table-top 102 to move up and down with the application of a force. Similarly, when the spring-loaded button 182 is released, the balancing disk 180 adheres to the second side 174 of the table-top 102 holding the balancing wheel disk 180 in fixed position. This allows quick adjustments to make a level of the push block 100 (particularly level of the table-top 102) parallel to a level of a saw table before each cut of the work piece, which will be explained in greater detail herein later. The adjustment of the level of the push block 100 (i.e. a movement of the balancing disk 180) is required when the push block 100 is off balance (i.e. when the push block 100 rests at an angle to the saw table) and when the push block 100 is placed on top of a narrow work piece. It should be noted that the functionality of the balancing disk 180 may be primarily achieved using any flat polygonal structure, such as a rectangular plate or a square plate. In other words, a circular shape of the balancing disk 180 should not be considered as limiting for the function of the balancing disk 180.

Figure 3:
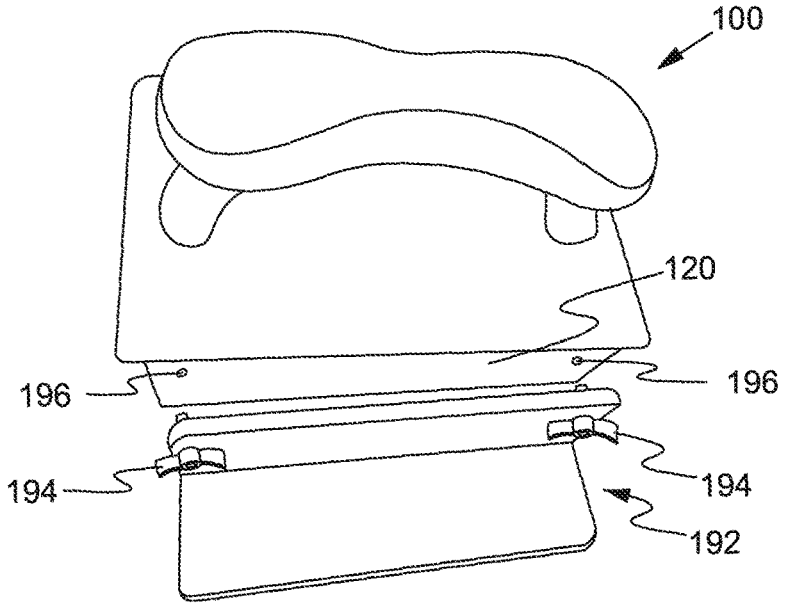
FIG. 3 is perspective view of the push block along with a L-shaped spacer, in accordance with an embodiment of the present disclosure.

Referring now to FIG. 3, illustrated is a perspective view of the push block 100 along with a L-shaped spacer 192, in accordance with an embodiment of the present disclosure. The L-shaped spacer 192 is operable to be detachably coupled to the first leg 120. As shown, the L-shaped spacer 192 is operable to be detachably coupled to the first leg 120 using a pair of wing nuts 194. The first leg 120 includes a pair of holes 196 to threadably receive the pair of wing nuts 194 and thereby for allowing detachable threadable coupling of the L-shaped spacer 192 with the first leg 120. The L-shaped spacer 192 is used for making wider cuts on the work piece. Therefore, the use of the L-shaped spacer 192 depends on a width of the cut to be employed on the work piece. In an example, the push block 100 along the L-shaped spacer 192 can be used to make rip cuts, on the work piece, having a width belonging to a range of 2.75 to 4.75 inches. Alternatively, the push block 100 (without the L-shaped spacer 192) is operable to make rip cuts, on the work piece, having a width belonging to a range of 0.25 to 2.75 inches.

According to an embodiment, the table-top 102 of the push block 100 includes measurement marks 198 (shown in FIG. 1) for adjusting the width of the cut tunnel 'U'. Specifically, based on a width of the rip cut to be employed, the width of the cut tunnel 'U' may be adjusted by moving the second leg 130 with respect to the fixed first leg 120 using the measurement marks 198 on the table-top 102.

Figure 4:
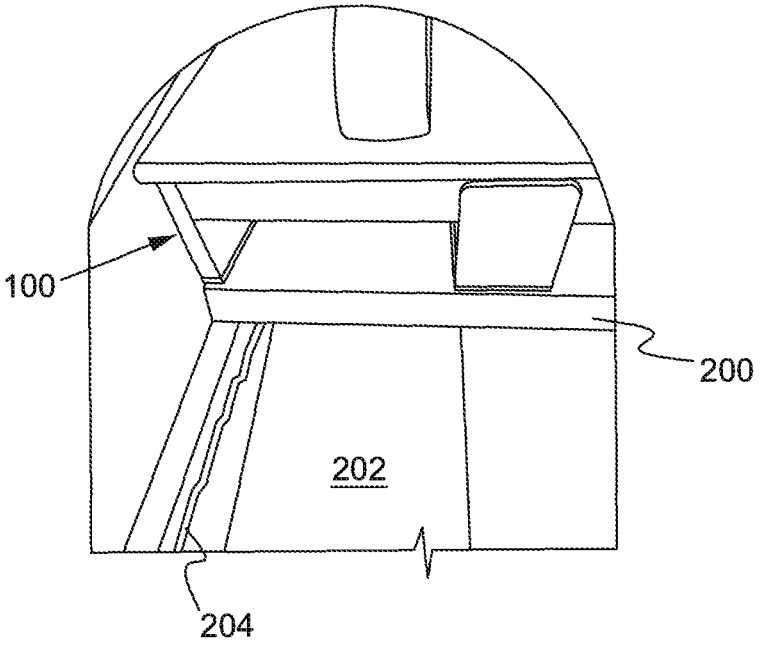
FIGS. 4-5 are schematic views of the push block in operation, i.e. used for advancing a work piece over a table saw, in accordance with various example embodiments.
Figure 5:
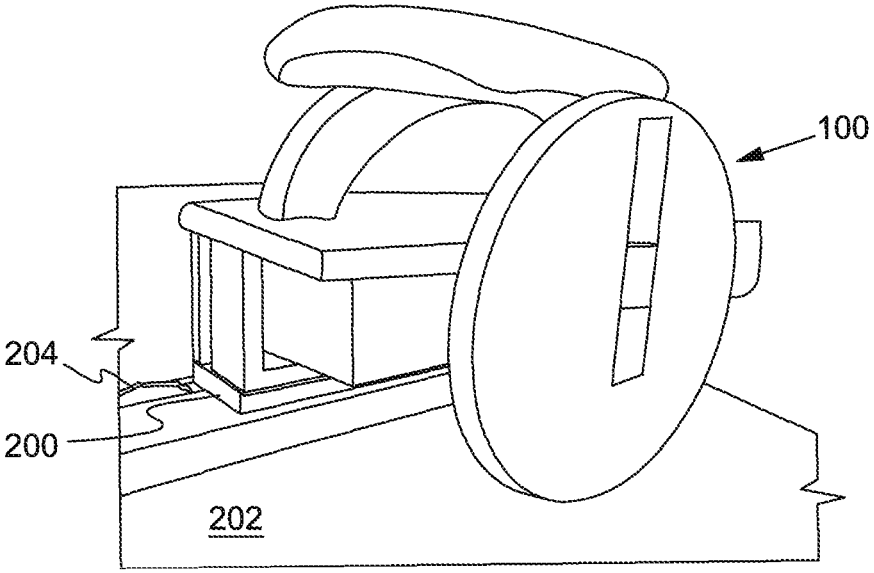

Referring now to FIGS. 4-5, illustrated are schematic views of the push block 100 in operation, i.e. when used for advancing a work piece 200 over a table saw 202, in accordance with various example embodiments. As shown in FIG. 4, the first and second legs 120, 130 are placed over the work piece 200 for firmly holding the work piece 200 while advancing the work piece 200 towards a saw blade 204. Further, FIG. 4 illustrates an exemplary state when the push block 100 is used for making a narrow rip cut, on the work piece 200, having a width, for example, of about 0.25 inches. As shown in FIG. 4, a width of the work piece 200 is large, for example more than 5 inches, in such state the balancing disk 180 (shown in FIGS. 1 and 2) is not used. It will be appreciated that depending on a width of the work piece 200, the balancing disk 180 may or may not be used. Specifically, as long as both the first and second legs 120, 130 can be placed on the work piece 200 or the work piece 200 has enough width to allow the first and second legs 120, 130 to rest thereon, the balancing disk 180 may not be required to use. However, referring now to the FIG. 5, the balancing disk 180 is used for advancing the work piece 200 over the table saw 202 towards the saw blade 204. As shown in FIG. 5, a width of the work piece 200 is small, for example about 1 inch, in such state the balancing disk 180 is allowed to rest on top of a saw table such that the push block 100, particularly, a level of the table-top 102 of the push block 100 becomes parallel to a level of the saw table. This allows the push block 100 to attain balanced position for being used in conjunction with narrow work pieces, such as the work piece 200 of FIG. 5 (having a width of about 1 inch), to make narrow rip cuts (of about 0.25 inches) on such narrow work pieces.

In operation, the first leg 120 of the push block 100 is placed on top of the work piece (such as the work piece 200) and is moved directly alongside a rip fence of the table saw (such as the table saw 202) for achieving straight and parallel rip cuts on the work piece. The first leg 120 grips an inside portion of the work piece between the saw blade (such as the saw blade 204) and the rip fence and guides the inner portion of the work piece towards the saw blade. The second leg 130 is adjusted to grip an outer section of the work piece relative to the saw blade. The second leg 130 then provides the pressure to guide the outside section of the work piece through the rip cut, holding it steady and parallel to the saw blade. To adjust the position of the second leg 130, the rotating wheel 170 may be rotated, i.e. to adjust a width of the cut tunnel 'U'. The width of the cut tunnel 'U' should be such that the first and second legs 120, 130 are positioned on either side of the saw blade and the saw blade passes through the cut tunnel for every cut.

In case, when the push block 100 is not balanced on the work piece, the first and second legs 120, 130 are placed on the work piece and the balancing disk 180 is adjusted to make the table-top 102 of the push block 100 parallel to the saw table. The balancing disk 180 is adjusted by pressing the spring-loaded button 182 (in the middle of the balancing disk 180) and applying pressure on top of the balancing disk 180 to move downward and contact the saw table. The balancing disk 180 may be re-adjusted by pushing the spring-loaded button 182 again and by applying pressure on the bottom of the balancing disk 180, and thereby moving the balancing disk 180 upward. Accordingly, when the first leg 120 is set against the saw fence and inside the saw blade, the second leg 130 is set on the work piece on the other side of the saw blade, and the push block 100 is balanced parallel to the saw table, and the work piece is ready to be subjected to rip cut. The rip cut is made by applying downward and forward pressure via the handle 110 of the push block 100 to guide the work piece completely through the cut, i.e. the saw blade will pass under the push block 100 through the cut tunnel created by the first and second legs 120, 130. The cut tunnel has a vertical clearance of about 1 inch. Further, while making rip cut, the saw blade may not be set more than 0.80 inches higher than a top surface of the work piece. Also, the top gullet should be just above the work piece.

In case of making wide rip cuts, for example of about 2.75 to 4.75 inches, the L-shaped spacer 192 is coupled to the first leg 120 with the pair of wing nuts 194. Further, for making wider cuts, an edge of the L-shaped spacer 192 should maintain contact with the rip fence. In other words, the push block 100 must always be in contact with the rip fence during operation either via the first leg 120 or the L-shaped spacer 192. In case of handing, a work piece that is wider than 18 inches, two push blocks (such as the push block 100) with one hand on each push block may be used to feed the wide work piece through the saw blade continuously.

Embodiments of the present disclosure substantially eliminate or at least partially address the aforementioned problems in the background and provide a push for advancing a work piece over a table saw. The push block enables in making narrow and precise rip cuts (of about 0.25 inches) on work pieces, because the first and second legs of the push block are configured to firmly hold over the work piece at two sides (or portions) while maintaining a narrow gap between the first and second legs. The first and second legs firmly hold the work piece with a narrow cut tunnel therebetween, for allowing a saw blade to pass through the cut tunnel and thereby enabling narrow and precise rip cuts on the work pieces. Further, the push block also enables in making precise narrow rip cuts on a narrow work piece, i.e. when a width of the work piece (or stoke) is small, for example, of about 1 inch. Specifically, an adjustable nature of a balancing disk of the push block allows the push block to attain balance and firm grip over the narrow work piece. The balancing disk can be adjusted to make a level of the push block (particularly, a level of a table-top of the push block) parallel to a level of a saw table while firmly holding the narrow work piece for being subjected to narrow rip cuts. The push block of the present disclosure is also operable to make wide rip cuts on the work pieces, having a width belonging to a range of 2.75 to 4.75 inches, with the help of an L-shaped spacer. Finally, the push block of the present disclosure is easy and safe to operate.

The embodiments illustrated and described herein as well as embodiments not specifically described herein but within the scope of aspects of the invention constitute exemplary push block for advancing a work piece over a table saw.

The benefits and advantages described above may relate to one embodiment or may relate to several embodiments. The embodiments are not limited to those that solve any or all of the stated problems or those that have any or all of the stated benefits and advantages.

Aspects of any of the examples described above may be combined with aspects of any of the other examples described to form further examples without losing the effect sought.

The above description is given by way of example only and various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

What is claimed is:

1. A push block for advancing a work piece over a table saw, the push block comprising:

a table-top;

a handle mounted on the table-top;

a first leg having a proximal end mounted on a first side of the table-top, wherein the first leg comprises a first grip member arranged on a distal end of the first leg;

a second leg having a proximal end movably mounted underneath the table-top, the second leg spaced apart from the first leg to form a cut tunnel therebetween, wherein the second leg comprises a second grip member arranged on a distal end of the second leg; and a maneuvering mechanism, arranged on the table-top, for moving the second leg to adjust a width of the cut tunnel, wherein the maneuvering mechanism comprises:

an elongate threaded rod having a first end coupled to the first leg, wherein the elongate threaded rod passes through and threadably engages with a support member arranged on an intermediate member; and a rotating wheel threadably engaged with a second end of the elongate threaded rod, wherein the table-top comprises a cut-out section configured to receive the rotating wheel therein.

2. The push block as claimed in claim 1, further comprising a balancing disk slidably mounted on a second side, opposite to the first side, of the table-top.

3. The push block as claimed in claim 2, wherein the balancing disk slidably mounted on a second side of the table-top using a spring-loaded button.

4. The push block as claimed in claim 3, wherein the balancing disk comprises a through channel to operably receive the spring-loaded button therethrough.

5. The push block as claimed in claim 3, wherein the balancing disk comprises a pair of spaced apart T-shaped tabs arranged along a face of the balancing disk, wherein the second side of the table-top comprises a pair of spaced apart recesses configured to receive the pair of spaced apart T-shaped tabs therein to allow the pair of spaced apart T-shaped tabs to slidably move along the pair of spaced apart recesses.

6. The push block as claimed in claim 1, wherein the handle comprises a central grasping portion, and curved connecting members extending from the central grasping portion and coupled to the table-top.

7. The push block as claimed in claim 1, wherein the first leg is a planer structure with the proximal end thereof rigidly mounted on the first side of the table-top.

8. The push block as claimed in claim 1, wherein the first leg comprises a thickness of 0.25 inches.

9. The push block as claimed in claim 1, wherein the second leg is an elongate U-shaped structure having the intermediate member arranged between the proximal and the distal end of the second leg in a spaced apart manner.

10. The push block as claimed in claim 1, wherein an intermediate member comprises a pair of spaced apart protruding members, each having a T-shaped portion arranged thereon.

11. The push block as claimed in claim 10, wherein the table-top comprises a pair of spaced apart channels arranged underneath the table-top, the pair of spaced apart channels is configured to receive the T-shaped portion of the pair of spaced apart protruding members to allow the T-shaped portion to slidably move along the pair of spaced apart channels.

12. The push block as claimed in claim 1, wherein the second leg comprises a thickness of 1 inch.

13. The push block as claimed in claim 1, wherein the push block is operable to make rip cuts of width belonging to a range of 0.25 to 2.75 inches.

14. The push block as claimed in claim 1, wherein the table-top comprises measurement marks for adjusting the width of the cut tunnel.

15. The push block as claimed in claim 1, further comprising an L-shaped spacer operable to be detachably coupled to the first leg.

16. The push block as claimed in claim 15, wherein the L-shaped spacer is operable to be detachably coupled to the first leg using a pair of wing nuts.

17. The push block as claimed in claim 15, wherein the L-shaped spacer along with the push block is operable to make rip cuts of width belonging to a range of 2.75 to 4.75 inches.

18. A push block for advancing a work piece over a table saw, the push block comprising:

a table-top;

a handle mounted on the table-top;

a first leg having a proximal end mounted on a first side of the table-top, wherein the first leg comprises a first grip member arranged on a distal end of the first leg;

a second leg having a proximal end movably mounted underneath the table-top, the second leg is spaced apart from the first leg to form a cut tunnel therebetween, wherein the second leg comprises a second grip member arranged on a distal end of the second leg;

a maneuvering mechanism, arranged on the table-top, for moving the second leg to adjust a width of the cut tunnel, wherein the maneuvering mechanism comprises:

an elongate threaded rod having a first end coupled to the first leg, wherein the elongate threaded rod passes through and threadably engages with a support member arranged on an intermediate member of the second leg, and a rotating wheel threadably engaged with a second end of the elongate threaded rod, wherein the table-top comprises a cut-out section configured to receive the rotating wheel therein; and a balancing disk slidably mounted on a second side, opposite to the first side, of the table-top.

19. A push block for advancing a work piece over a table saw, the push block comprising:

a table-top;

a handle mounted on the table-top;

a first leg having a proximal end mounted on a first side of the table-top, wherein the first leg comprises a first grip member arranged on a distal end of the first leg;

a second leg having a proximal end movably mounted underneath the table-top, the second leg is spaced apart from the first leg to form a cut tunnel therebetween, wherein the second leg comprises a second grip member arranged on a distal end of the second leg;

a maneuvering mechanism, arranged on the table-top, for moving the second leg to adjust a width of the cut tunnel, wherein the maneuvering mechanism comprises:

an elongate threaded rod having a first end coupled to the first leg, wherein the elongate threaded rod passes through and threadably engages with a support member arranged on an intermediate member of the second leg, and a rotating wheel threadably engaged with a second end of the elongate threaded rod, wherein the table-top comprises a cut-out section configured to receive the rotating wheel therein; and a balancing disk slidably mounted on a second side, opposite to the first side, of the table-top, the balancing disk comprises a pair of spaced apart T-shaped tabs arranged along a face of the balancing disk, wherein a second side of the table-top comprises a pair of spaced apart recesses configured to receive the pair of spaced apart T-shaped tabs therein to allow the pair of spaced apart T-shaped tabs to slidably move along the pair of spaced apart recesses.

* * * * *